United States Patent [19]

Dremann

[11] 3,941,588

[45] Mar. 2, 1976

[54] COMPOSITIONS FOR ALLOYING METAL

[75] Inventor: Charles Earl Dremann, Chester, Pa.

[73] Assignee: Foote Mineral Company, Exton, Pa.

[22] Filed: Feb. 11, 1974

[21] Appl. No.: 441,288

[52] U.S. Cl. ..... 75/94; 75/68 R; 75/93 AC; 75/138; 148/23; 148/24; 148/25

[51] Int. Cl.[2] ..... C22B 9/12

[58] Field of Search ..... 148/25, 24, 23; 75/138, 75/135, 68 R, 93 G, 93 R, 93 A, 93 B, 94, 93 AC

[56] References Cited

UNITED STATES PATENTS

| | | | |
|---|---|---|---|
| 2,797,201 | 6/1957 | Veatch et al. | 260/2.5 B |
| 2,848,321 | 8/1958 | Bunbury et al. | 148/24 X |
| 3,721,797 | 3/1973 | Arikawa et al. | 148/24 X |
| 3,731,868 | 5/1973 | Arikawa et al. | 148/23 X |

*Primary Examiner*—L. Dewayne Rutledge
*Assistant Examiner*—M. J. Andrews
*Attorney, Agent, or Firm*—Howson and Howson

[57] ABSTRACT

A method, compositions and articles are described for the direct addition of alloying metal to a molten metal to be alloyed, which provide more rapid dissolution of the alloying metal in the molten metal than has been possible heretofore. The alloying metal is added to the molten metal to be alloyed in finely particulate form in intimate admixture with a flux suitable for the purpose and finely particulate phenolic resin. The phenolic resin, in particle form, and preferably in the form of low density microballoons, is employed in an amount such that the ratio of the volume of the metal-flux mixture to the volume of the microballoons is in the range from about 2:1 to about 12:1. The flux-alloying metal mixture contains about 3 to about 10% flux and about 90 to about 97% alloying metal, by weight of the flux-metal mixture. The compositions may be added to the molten metal bath in powder or lump form or may be incorporated in articles such as bags or briquettes containing the compositions. The method, compositions and articles are particularly useful for alloying aluminum and especially for the addition of manganese or chromium to aluminum. The preferred fluxes for alloying aluminum are non-hygroscopic metal salts, particularly chlorides and fluorides; a flux composed of 40% sodium chloride, 40% potassium chloride and 20% cryolite being especially useful for the addition of manganese or chromium to aluminum.

8 Claims, 2 Drawing Figures

COMPOSITIONS FOR ALLOYING METAL

BACKGROUND OF THE INVENTION

It is well-known in the art that the rate of dissolution of an alloying metal in the molten metal to be alloyed is the limiting factor in the production of such alloys and that for this reason it is desirable to reduce to a minimum the time required to add and dissolve the additive metal. In the production of manganese alloys of aluminum, for example, manufacturers are willing to accept slightly higher manganese cost and somewhat lower manganese recovery in the alloy in order to increase the rate of dissolution of the manganese in the aluminum. Manganese-aluminum alloys are important materials and, indeed, constitute a large proportion of all aluminum products. Alloys of this type, other than so-called master alloys, generally contain no more than about 1.5% manganese, by weight, although alloys containing up to 2 to 3% manganese may be useful for some purposes. Master alloys, which are intended to be dissolved in molten aluminum to make ordinary manganese-containing aluminum alloys, may contain from about 4 to 30% manganese. As a rule, however, lesser amounts of manganese, i.e., from 1.5% down to as little as about 0.01% are employed in commercial aluminum alloys. For example, type 3003 aluminum-manganese alloy, which contains from about 1.0 to 1.5% manganese, retains the high corrosion resistance of pure aluminum, but has much greater strength than commercial pure aluminum and also exhibits excellent forming and welding properties which adapt it for use in a wide variety of applications, such as aluminum foil and extruded shaped articles. Type 5056 manganese-aluminum alloy, which contains about 0.01% manganese, is a well-known example of a low manganese type of aluminum alloy.

The direct addition of manganese metal to molten aluminum is difficult, due to the fact that the melting point of manganese (1245°C.) is much higher than the melting point of aluminum (660°C.). Moreover, the rate of dissolution of metallic manganese in molten aluminum is normally very slow. As might be expected, in general, the smaller the particle size of the manganese metal, the faster its rate of dissolution in aluminum. For example, manganese chips dissolve in molten aluminum more rapidly than larger lumps of the metal. Despite this observation, it is not possible to pursue this advantage to its ultimate conclusion and simply add finely powdered manganese to molten aluminum. This is due to the fact that when powdered manganese is added to a bath of molten aluminum it floats on the surface and is sintered to a hard crust, with the result that much of the manganese is oxidized and fails to be recovered as manganese metal in the final alloy. For this reason, powdered manganese has previously been added to molten aluminum chiefly in the form of briquettes formed from mixtures of powdered manganese with powdered aluminum. While such composite powdered manganese-aluminum briquettes provide better results than powdered manganese alone, they have not proven entirely satisfactory. Briquettes composed substantially entirely of manganese powder have been found entirely unsatisfactory since they do not dissolve in molten aluminum. More recently, however, it has been discovered that powdered manganese may be added to molten aluminum together with a flux without undue sintering of the manganese.

In view of the above, the most usual means of adding manganese metal to aluminum has been to prepare an aluminum-manganese master alloy containing from about 4 to 30% manganese by weight. Such master alloys have the advantage of dissolving relatively rapidly in molten aluminum and also provide homogeneous distribution of the manganese throughout the aluminum bath. Despite these advantages, such master alloys have presented handling and storage problems for both users and producers and have the further disadvantage of being uneconomically high in cost. Therefore, a need has long existed for a simple, economical method for adding manganese metal directly to molten aluminum in such a way as to provide rapid dissolution of the manganese in the aluminum. The foregoing specific illustrative comments are also generally applicable to the addition of chromium and other additives to aluminum and are also generally applicable to the addition of any alloying metal to any molten metal.

The Prior Art

The problems involved in the direct addition of alloying metal to a molten metal to be alloyed, and, in particular, to the addition of alloying ingredients to low alloy steels during tapping, are discussed in Saunders et al U.S. Pat. No. 2,935,397 issued May 3, 1960, which suggests the use of an organic binder in a mixture comprising one or more alloying materials. When such an addition agent is dissolved in a steel melt the organic binder burns and evolves gases which turbulently agitate the melt, thereby promoting uniform dissolution of the alloying materials. Suitable binders for this purpose are said to be abietic acid, wood rosins and higher melting derivatives of the latter, which will not cake during storage.

Brown et al in U.S. Pat. No. 3,592,637 issued July 13, 1971 describe a method for the addition of a wide variety of alloying ingredients to molten aluminum by the use of addition agents containing from 10 to about 90% finely divided aluminum and 10 to 90% of the alloying agent.

The specific problem of adding manganese to aluminum is discussed in Austrian Patent No. 211,559 issued Oct. 25, 1960, which suggests that the manganese be introduced in the form of briquettes containing manganous chloride and other chlorides, with or without the addition of a fluoride. More specifically, the recommended briquettes would contain about 80% manganese powder, about 10% manganous chloride and about 10% of other chlorides, preferably 5% sodium chloride and 5% potassium chloride. Optionally, a fluoride capable of dissolving the deoxidation products formed during alloying may also be employed. Manganous chloride, an essential ingredient of these briquettes, being a hygroscopic material, tends to pick-up sufficient moisture from the atmosphere to cause excessively violent and even explosive agitation of the molten aluminum bath. For this reason, it would be not only difficult but dangerous to employ such briquettes on a commercial scale.

My co-worker, Jordan P. Tuthill, in U.S. Pat. No. 3,591,369 issued July 6, 1971, has suggested the direct addition of manganese metal to molten aluminum by means of a manganese body such as a chip coated with a composition containing potassium fluoride and which forms a molten phase at the temperature of the molten aluminum. Inasmuch as pure potassium fluoride is a high melting salt, the coating must also contain at least one other chemically bound element which lowers the melting point of the coating sufficiently to provide a molten phase at or below 710°C. which is about the upper limit of the normal alloying temperatures for aluminum. Such elements may be selected from the group consisting of sodium, aluminum, manganese, titanium and zirconium, which metals are preferably employed in the form of fluorides.

My co-workers, Kline, Yeh and Preston, have disclosed in U.S. Patent application Ser. No. 161,876, filed July 12, 1971, an improved method for alloying aluminum which comprises employing the fluxes of the Tuthill invention in conjunction with powdered manganese rather than manganese chips in order to achieve still more rapid dissolution of the manganese in the molten aluminum bath. In these compositions the powdered manganese makes up about 90 to 97%, and the flux about 3 to about 10% of the mixture by weight.

In view of the foregoing, it is apparent that despite significant advances in the art looking toward the direct addition of manganese to molten aluminum, a need remains for other methods for accomplishing this result in a convenient manner with acceptable recovery of manganese in the final alloy and improved rapidity of solution. Such a method which would also be applicable to the addition of chromium or other additives to molten aluminum or indeed to the addition of any alloying metal to any molten metal would, of course, also be greatly desired.

It is, therefore, a principal object of the present invention to provide a method to meet these recognized needs in the art.

More specifically, it is an object of the present invention to provide a novel rapid method for the addition of finely divided alloying metal to a molten metal bath and, in particular, a method of this type for the addition of powdered manganese or chromium to molten aluminum.

It is still another object of the invention to provide compositions and articles for the addition of powdered manganese and chromium to molten aluminum at a higher rate than has previously been possible while still maintaining an acceptably high recovery of the alloy metal in the final alloy and accomplishing these objects in a convenient, safe and economical manner.

BRIEF SUMMARY OF THE INVENTION

The present invention provides a method, compositions and articles for the direct addition of alloying metal to a molten metal bath in such a way as to overcome the disadvantages of the methods of the prior art and provide previously unattainable rates of dissolution of the alloying metal in the molten metal bath. While the invention is widely applicable to the addition of alloying metals to molten metals to be alloyed, it is especially useful for the addition of manganese and chromium to molten aluminum. Therefore, for reasons of simplicity, the invention will be described in detail herein in connection with the preferred embodiment in which manganese is added to molten aluminum. It is to be understood, however, that the specific description herein is equally applicable to the addition of chromium to molten aluminum and, indeed, is generally applicable to the addition of any alloying additive to any molten metal bath.

Any suitable flux may be employed in the present invention depending upon the particular alloying ingredients and molten metal to be alloyed; appropriate fluxes for each such system being well-known in the art. The preferred fluxes for the addition of manganese and chromium to aluminum are those described by my co-workers Kline, Yeh and Preston in U.S. Patent application Ser. No. 161,876, filed July 12, 1971; the disclosure of which application is incorporated herein by reference.

As noted above, the fluxes operable in the present invention must be capable of forming a molten phase at the temperature of the bath of molten metal. When the molten metal is aluminum, the flux should, therefore, form a molten phase at a temperature in the range from about 660°C. up to about 710°C. The manganese-flux compositions are added to the molten aluminum bath in amounts calculated to provide the desired concentration of manganese in the final alloy, e.g., from about 0.1 to about 1.5% or up to about 3% by weight of manganese in the aluminum alloy. Inasmuch as manganese-flux compositions contain about 90 to 97% manganese by weight, the amount of these compositions added to the aluminum is about the same order of magnitude, although somewhat higher (3 to 10%) than the percentage of manganese desired in the final alloy. The manganese-flux compositions also contain in intimate admixture therewith particulate phenolic resin as an essential ingredient; the ratio of the volume of the metal-flux mixture to the volume of the phenolic resin being in the range from about 2:1 to about 12:1 or 16:1. While a volume ratio of 1:1 or higher may be employed, if desired, such large amounts of phenolic resin are generally unnecessary and uneconomic. On the other end of the scale, amounts of phenolic resin below the 12:1 ratio such as 16:1 may be employed in some cases with satisfactory but usually less than optimum results. The preferred volume ratio of metal-flux to phenolic resin is about 4:1. It is preferred but not essential in all cases that the phenolic resin be in the form of low density microballoons of the type available commercially.

The powdered manganese-flux-phenolic resin additives may be handled in any suitable way for introduction to the molten aluminum as long as the additive composition is positively placed below the surface of the molten aluminum bath and any dross thereon. Any conventional means known to the art may be employed for this purpose. For added convenience, the powdered additives may be enclosed in a suitable consumable container for addition to the aluminum bath, e.g., a bag or envelope of aluminum foil, paper or moisture-proof laminate; preferably a polyethylene-aluminum foil-Kraft paper laminated bag is used. In another, but less preferred embodiment of the invention, the manganese-flux powder-phenolic resin additive may be formed into briquettes by conventional procedures and added in that form. Briquetting is not recommended, however, for phenolic resin microballoons since the compression required to form the briquettes tends to crush the microballoons and reduce their effectiveness, although such briquettes are still useful. For this reason, it would be preferable to use ordinary particulate phenolic resin in such briquettes. While good results may be obtained with briquettes containing particulate phenolic resin, it has been found that the addition of the new compositions in the form of a free-flowing powder, either as such or enclosed in an envelope, provides more rapid dissolution of the manganese in the aluminum than is normally achieved using compacted briquettes, particularly if a strong binder is required to form the briquettes.

While the invention is especially useful for adding manganese directly to the molten aluminum to provide alloys containing from about 0.1 to 1.5% or up to 3%, by weight, of the manganese, it may also be used to produce aluminum master alloys containing from about 4 to about 30% manganese by appropriate adjustment of the amounts of the new additive compositions or articles added to the aluminum bath, i.e., from somewhat more than 4 to somewhat more than 30% by weight of the additives, depending on the concentration of manganese in the additive. Similarly, chromium or other metal additive master alloys may also be produced in the same way.

The method of the invention and the new compositions, whether in the form of free flowing powders or briquettes, have been found to markedly increase the rate of solution of the additive metal, whether it be manganese, chromium or other metals, in the molten metal bath, and to provide excellent recoveries of the additive metal in the final alloy. The reason for the marked increase in solution rate is not presently understood, although it is clearly due to the presence of the particulate phenolic resin. It has also been observed that the lower the density of the phenolic resins employed, the better the results, in general. It appears that the low density resin aids in separating the manganese or other additive metal particles and thus reduces the sintering and loss of such additive metals. The low density phenolic resin also appears to aid in slowing the sinking of the additive metal to the bottom of the molten metal bath, thus aiding in solution. It has been found, moreover, that the particulate phenolic resin is far superior to the abietic acid and wood rosin binders of the prior art in promoting solution of the additive metals.

While the particle size of the manganese powder may vary widely, it is preferred that it be essentially minus 14 mesh, and primarily plus 100 mesh. By this it is meant that substantially all of the manganese particles will pass through a standard 14 mesh screen and be retained on a standard 100 mesh screen. While it is, of course, desirable that the particle size of the manganese metal be relatively fine, i.e., minus about 14 mesh in order to promote rapid dissolution in the molten aluminum, it is preferred that no more than about 20% by weight of manganese particles be minus 100 mesh, in order to prevent undue losses of manganese in the final alloy due to oxidation of such fines. The distribution of particle sizes within the stated range is not critical and various distributions of particle sizes within the above ranges have been found to be entirely suitable. For example, specific powdered manganese additives have been tested containing manganese particles of (1) substantially all minus 30 mesh and plus 100 mesh; (2) substantially all minus 30 mesh and smaller; and (3) substantially all minus 20 mesh and smaller, all mixed with about 10% by weight of flux based on the total flux-additive metal compositions.

The amount of flux required for best results depends to some extent upon the particle size of the manganese powder employed and the degree of oxidation of its surface; the finer the manganese powder, the greater the proportion of oxide on its surface, in general, and, therefore, the more flux required to hasten its solution. In general, if the particle size of the manganese powder is in the range from about minus 14 mesh to plus 100 mesh, or minus 14 mesh and smaller with no more than about 20% minus 100 mesh, about 3 to about 10% of flux, by weight of the total flux-additive metal compositions is employed. From these general considerations, those skilled in the art will be able to select an appropriate flux concentration within the about 3 to about 10% range, or at somewhat lower or higher concentration levels for larger or smaller mesh manganese particles, respectively.

The fluxes for addition of manganese to aluminum, as noted above, are chlorides or fluorides, or mixed chlorides and fluorides, which are capable of forming a molten phase at the temperature of the molten aluminum to which the manganese-flux-phenolic resin compositions are added in order to aid in the wetting of the manganese particles by the aluminum and thus facilitate solution of the manganese in the aluminum. Suitable fluxes of this type include those described in the Tuthill U.S. Pat. No. 3,591,369 issued July 13, 1971, as noted above. The Tuthill patent teaches that potassium fluoride, which is an excellent flux, has a melting point of 810°C., which is well above the 710°C. normal upper limit of aluminum alloying temperatures and, therefore, when it is desired to alloy aluminum at a temperature below 710°C., but above the melting point of aluminum (660°C.) it is necessary to lower the melting point of the potassium fluoride by the addition of another chemically bound element. Suitable materials for this purpose include the chlorides and fluorides of sodium, aluminum, titanium and zirconium, and manganese fluoride. Manganous chloride is not desirable in a flux for aiding the dissolution of manganese in molten aluminum since, due to its hygroscopic nature, it normally carries with it sufficient moisture to cause unacceptably violent agitation of the molten aluminum bath. Otherwide, the chemical identity of the flux is not critical, however, so long as it is capable of forming a molten phase at the temperature of the aluminum bath and also serves to aid in the wetting of the manganese particles by molten aluminum. Suitable fluxes include $MgF_2$, $K_2ZrF_6$, KF, $AlF_3$, LiF, $ZrF_4$, KCl, LiCl, $MgCl_2$, $ZrCl_4$ and mixtures of these salts. While $K_2TiF_6$ is a particularly suitable flux, it is more expensive than the preferred flux of the invention, which consists of a mixture of KCl, NaCl and cryolite. An especially preferred flux consists of 40% KCl, 40% NaCl and 20% cryolite ($Na_3AlF_6$). As noted above, other fluxes known to the art, but not specifically listed herein, may be employed with the additive-matrix metal systems with which they are normally used.

DETAILED DESCRIPTION OF THE INVENTION

Figure 1:
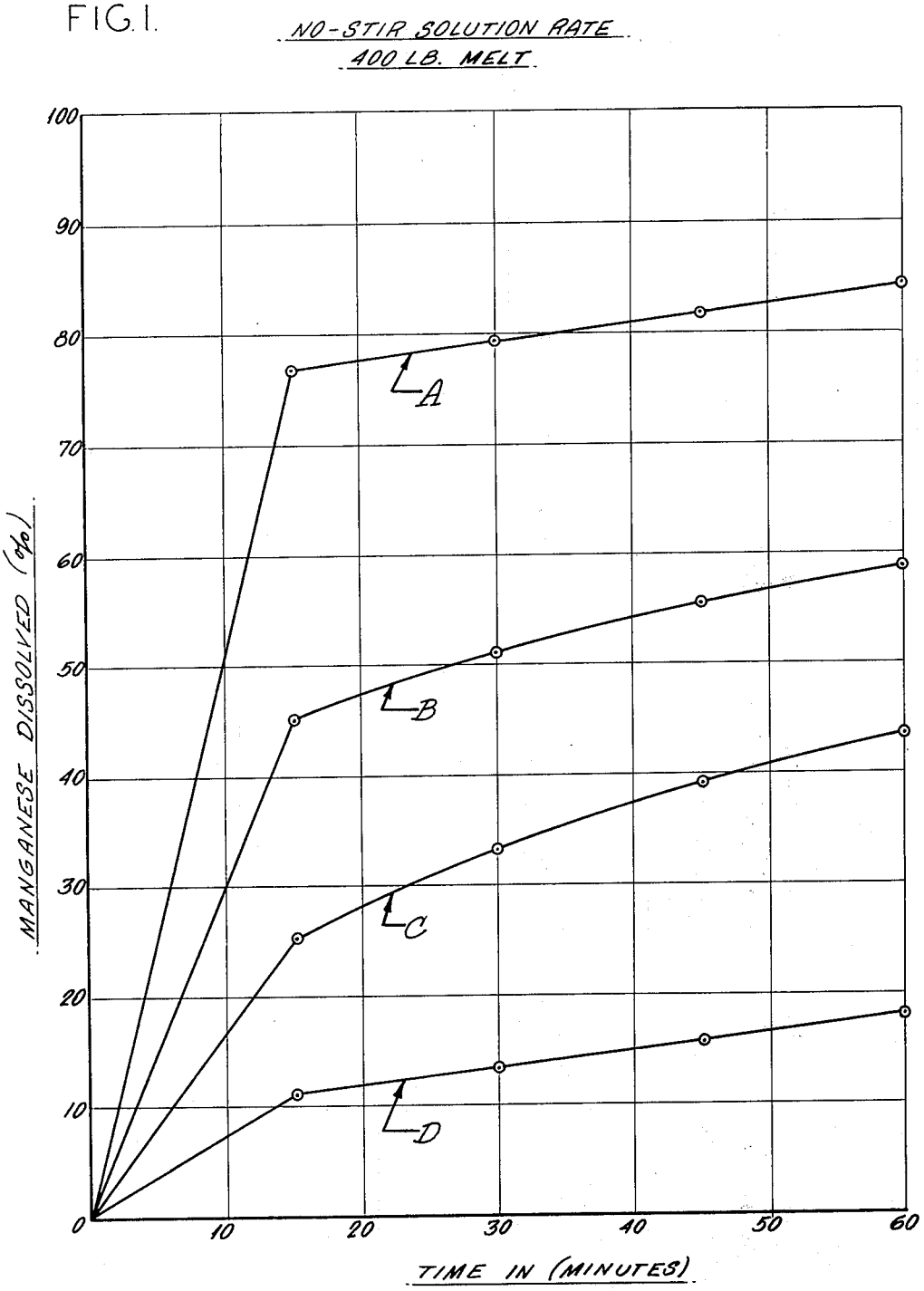

It is well-known to those skilled in the art that the rate of solution of an additive in a metal bath is a function of the temperature of the molten metal, the degree of stirring or other agitation, the geometry of the furnace or vessel and, of course, the particular additive and metal being alloyed. Therefore, no meaningful comparison of data from different tests may be made unless the tests were conducted under the same conditions. Of the several standard tests used in our laboratories to evaluate alloying additives, a test without any stirring of the molten metal bath has been found to best show the differences between various additives or methods of addition. While stirring is generally employed in commercial practice, the method and compositions of the present invention are so superior that such stirring may not be required.

The invention will now be illustrated in greater detail in conjunction with the following specific examples.

EXAMPLES 1 THROUGH 5

A crucible type pot furnace having a capacity of 400 lbs. of molten aluminum was employed in a series of tests. The additives were formulated using powdered manganese having a particle size of minus 20 mesh in one series. Two other series of tests were run using different batches of powdered manganese having a particle size of minus 30 mesh plus 100 mesh. All tests using these manganese size distributions were successful. The matrices of molten aluminum were 99.5+% pure aluminum and all tests were conducted without stirring with the molten aluminum at a temperature of about 746°C. (1375°F.). The additives were compounded to supply 5 lbs. (2268 g.) of manganese powder to the 400 lb. aluminum melt, i.e., about 1.25% manganese addition. The granular additives were placed in plastic-aluminum foil-Kraft paper laminated bags which were then introduced to the molten aluminum. The briquettes were added to the bath by means of a shovel without bagging. Three liquid metal samples were taken in each test, the first at 15 minutes after addition of the alloying additive, the second at 15.5 minutes and the third at 16 minutes. Each sample was analyzed for manganese by X-ray fluorescence according to known procedures. At the end of each test the melt was stirred, sampled again, and the alloy removed from the furnace. Any clinker remaining in the crucible was weighed. Such clinkers, which often remain after unstirred tests are supposedly the remainder of the manganese pile added to the melt.

In Example 1, the additive consisted of a bag containing 2268 g. of powdered manganese, 100.8 g. of potassium chloride, 100.8 g. of sodium chloride and 50.4 g. of cryolite ($Na_3AlF_6$). The total weight of the salts constituting the flux was 252 g. which is 10% of the total weight (2520 g.) of the manganese flux mixture.

In Example 2, 18 g. of phenolic resin microballoons were placed in a bag with 2268 g. of powdered manganese and added to a 400 lbs. melt of aluminum to show the effect of the microballoons alone without any flux.

The present invention was illustrated by Example 3 in which the flux of Example 1 and microballoons of Example 2 were both bagged with 2268 g. of manganese powder.

The rosin of 3. et al U.S. Pat. No. 2,935,397 was used in Example 4 in which 18 g. of wood rosin was substituted for the phenolic microballoons of the present invention; the remainder of the bagged additive being the same as Example 3.

Finally, in Example 5, well-known prior art was illustrated in which 2268 g. of manganese was added in the form of briquettes also containing 756 g. of aluminum, (i.e., 75% Mn - 25% aluminum briquettes).

The results of these tests are set forth in the table below.

| Example No. | Ingredients (g.) Mn | KCl | NaCl | $Na_3AlF_6$ | Other | % Mn at 15 mins. | Clinker Weight (g.) |
|---|---|---|---|---|---|---|---|
| 1 | 2268 | 100.8 | 100.8 | 50.4 | 0 | .11 | 1352 |
| 2 | 2268 | | | | 18[a] | .04 | 585 |
| 3 | 2268 | 100.8 | 100.8 | 50.4 | 18[a] | .90 | 0 |
| 4 | 2268 | 100.8 | 100.8 | 50.4 | 18[b] | .18 | 641 |
| 5 | 2268 | | | | 756[c] | .50 | 1282 |

[a]Low density phenolic resin (microballoons)
[b]Wood Rosin
[c]Aluminum (briquettes)

It will be seen from the data above that at the end of 15 minutes only 0.11% of Mn was dissolved in the aluminum and a heavy clinker (1352 g.) remained at the end of the test when only the flux was mixed with the powdered manganese as in Example 1. In Example 2, when only the phenolic microballoons and no flux was used, the clinker was smaller (585 g.) but the manganese dissolved in aluminum after 15 minutes was only 0.04% or negligible. In Example 4, in which wood rosin was used in addition to the flux, the results were somewhat better than in Examples 1 and 2 with a 15 minute manganese recovery of 0.18% and a clinker weighing 641 g. Example 5, using 75% manganese-25% aluminum briquettes, which represents good prior practice, produced much better results than control Examples 1, 2 and 4, with the 15 minute manganese recovery being 0.5%, although a large clinker (1282 g.) remained. Example 3, illustrating the present invention, gave by far the best results; the 15 minute manganese recovery being 0.90% which is 80% higher than that of Example 5, the next best result obtained in this series of tests. It should also be noted that no clinker whatsoever remained at the end of the test illustrating the present invention, thus showing marked superiority of the method of the invention over the methods of Examples 1, 2, 4 and 5.

The phenolic resin microballoons used in the specific examples herein are available commercially and have been described in Kirk-Othmer, *Encyclopedia of Chemical Technology*, Second Edition, (1968), Volume 15, page 207. The microballoons are hollow spheres 0.0015 inch in diameter, composed of one-step phenolic resins. A small amount of a heat-sensitive nitrogen-containing blowing agent is incorporated in the liquid phenolic resin which is then spray dried. In the spray drying operation the stream of liquid resin containing the blowing agent is first broken-up into a fine spray and then introduced to the hot zone of the dryer, where the heat causes the blowing agent to give off nitrogen and expand the spheres and simultaneously cure the resin.

EXAMPLES 6, 7 and 8

The test procedure employed in Examples 1 through 5 was repeated using three different proportions of microballoons to the manganese-flux mixture. The preferred flux of the invention consisting of 40% potassium chloride, 40% sodium chloride and 20% cryolite was employed. The manganese powder used in these tests which was designated minus 30-plus 100 mesh, was obtained by passing manganese powder through a 26 mesh commercial screen onto a 74 mesh screen; the openings of said screens being 0.0275 and 0.0098 inch respectively. As before, the additives were charged to a 400 lb. melt of aluminum; 5 lbs. of manganese (2268 g.) being added in each case. In Example 6, only 2% of the flux, by weight, based on the total weight of the manganese-flux mixture was employed. In Examples 7 and 8, the amount of flux was increased to 10%, by weight, of the manganese-flux mixture. In Example 6 the volume ratio of microballoons to the manganese-flux charge was 1:4. Similarly, in Example 7 the ratio was 1:16, and in Example 8, 1:12.

| | | EXAMPLE | | |
|---|---|---|---|---|
| | | 6 | 7 | 8 |
| Charge | Mn (30×100)(Weight in Grams) | 2268 | 2268 | 2268 |
| | KCl | 20.2 | 100.8 | 100.8 |
| | NaCl | 20.2 | 100.8 | 100.8 |
| | Cryolite | 10.1 | 50.4 | 50.4 |
| | Microballoons | 18 | 4.5 | 6.0 |
| % Flux | | 2 | 10 | 10 |
| Microballoon: Mn-Flux Ratio | | 1:4 | 1:16 | 1:12 |
| % Mn at 15 minutes | | .48 | .26 | .45 |
| % Mn Recovery | | 87 | 99 | 87 |
| Clinker (Weight in Grams) | | 358 | 0 | 0 |

It will be seen from the data in the foregoing table that even at the 2% flux level of Example 6 with a microballoon to manganese-flux ratio of 1:4, a good rate of solution of manganese was achieved. Based on this and other tests, it is believed that the useful lower limit of flux is about 2%, and that at this level the microballoon to manganese-flux ratio is preferably as high as about 1:2, by volume. It will be seen from the data in the table above that when the amount of flux is raised to 10% and the microballoon to manganese-flux ratio may be reduced to about 1:12 and still achieve rapid dissolution of the manganese. Inasmuch as the rate of solution of the manganese drops off sharply at ratios below 1:12 as seen in Example 8, it is apparent that a ratio of about 1:12 or somewhat less is about the lower limit of the microballoon to manganese-flux ratio, although a somewhat lower ratio might be permissible if the proportion of flux were increased, e.g., up to about 20%, by weight.

A series of further tests were conducted employing 400 lb. aluminum melts with 5 lbs. of manganese (2268 g.) added together with varying proportions of the preferred 40% potassium chloride, 40% sodium chloride, 20% cryolite flux and varying proportions of microballoons. The proportions of flux were varied from 0 to 20%, by weight, of the manganese-flux mixture. The ratio of the volume of the microballoons to the volume of the manganese-flux mixture was varied from 1:2 to 1:8. The results of these tests, i.e, the percent manganese dissolved in 15 minutes and the percent of manganese recovery in each case are set forth below. The manganese powder used in these tests was the 30 × 100 powder described above.

NO-STIR SOLUTION RATE TEST RESULTS FOR VARIOUS FLUX- AND MICROBALLOON RATIOS

| % Flux | Microballoon Ratio 1:2 | 1:3 | 1:4 | 1:6 | 1:8 |
|---|---|---|---|---|---|
| 0 | 0.10% Mn at 15 minutes 94% Mn Recovery No clinker | | 0.04% Mn at 15 minutes 58% Mn Recovery 585 g. clinker | | 0.09% Mn at 15 minutes 94% Mn Recovery 594 g. clinker |
| 5 | | | 0.82% Mn at 15 minutes 86% Mn Recovery No clinker | | |
| 10 | Two tests: 0.93, 0.82 Mn at 15 minutes 87, 75% Mn Recovery No clinker | 0.82% Mn at 15 minutes 79% Mn Recovery No clinker | Two tests: 0.96, 0.90 Mn at 15 minutes 93, 87% Mn Recovery No clinker | 0.71% Mn at 15 minutes 94% Mn Recovery No clinker | 0.74% Mn at 15 minutes 96% Mn Recovery No clinker |
| 20 | 0.73% Mn at 15 minutes 87% Mn Recovery No clinker | | 0.81% Mn at 15 minutes 87% Mn Recovery No clinker | | 0.66% Mn at 15 minutes 90% Mn Recovery No clinker |

The above data and the data of Examples 6, 7 and 8, indicate that the proportion of flux may range from about 2 to about 20% and is preferably about 10%, by weight, of the flux-manganese metal mixture; the remainder, 80–98%, or preferably 90%, of the mixture being manganese. Similarly, the above data indicate that the proportion, volume to volume, of microballoons to flux-manganese mixture may be in the range from about 1:2 up to about 1:12, the preferred volume ratio being about 1:4. At the 1:4 ratio the weight ratio of microballoons to manganese-flux is about 0.71 to 100 (90 Mn – 10 flux).

As is well-known, the rate of stirring has an affect upon the rate of solution of manganese in molten aluminum. Therefore, a number of different manganese alloying additives were tested under different stirring conditions in order to compare their rates of solution. Additive (A) was a composition of the present invention in a laminated bag containing 2268 g. of manganese, 100.8 g. of potassium chloride, 100.8 g. of sodium chloride, 50.4 g. of cryolite and 18 g. of microballoons. Additive (B) was a commercial 75% manganese – 25% aluminum briquette. Additive (C) was a different brand of 75% manganese – 25% aluminum briquette. Additive (D) was the same as (A) except that the microballoons were omitted.

No stir tests were conducted as in Example 1 above with the aluminum bath at 746°C. (1375°F.) using each of the additives (A), (B), (C) and (D), the manganese content of the bath measured at 15 minutes, 30 minutes, 45 minutes and 60 minutes and the results plotted as shown in FIG. 1. It is apparent from FIG. 1 that additive (A) of the present invention had the highest rate of solution in the molten aluminum.

The recovery of manganese at 15 minutes and the final recovery of manganese in each of the foregoing no stir tests is shown in the following table.

COMPARISON OF SOLUTION RATE AND RECOVERY OF FAST DISSOLVING MANGANESE ADDITIVES

| | RAPID STIR TEST | | REGULAR STIR TEST | | NO-STIR TEST | |
|---|---|---|---|---|---|---|
| Additive | Mn Recovery in 15 mins. (%) | Final Mn Recovery (%) | Mn Recovery in 15 mins. (%) | Final Mn Recovery (%) | Mn Recovery in 15 mins. (%) | Final Mn Recovery (%) |
| (A) | 79.9 | 84.5 | 87.7 | 90.7 | 76.7 | 93.9 |
| | 81.0 | 89.9 | | | | |
| (B) | 92.0 | 93.6 | 73.7 | 98.2 | 44.9 | 93.8 |
| (C) | 92.3 | 95.0 | 71.3 | 100.8 | 25.5 | 94.8 |
| (D) | 98.6 | 99.4 | 46.8 | 97.7 | 11.1 | 81.0 |

The above table also shows for comparison purposes, the manganese recovery after 15 minutes and the final manganese recovery for additives (A), (B), (C) and (D) in regular stir and rapid stir tests. The rapid stir test simulated a production shop having ideal furnace conditions and a very high rate of stirring seldom achieved in commercial practice. The regular stir test simulated furnace conditions and stirring which would be typical of a well run commercial operation. The unstirred tests, of course, illustrated the poorest conditions of commercial practice, i.e., poor furnace conditions and little or no stirring. Typical average commercial conditions would probably be somewhere between the conditions of the no-stir tests and those of the regular stir test.

Figure 2:
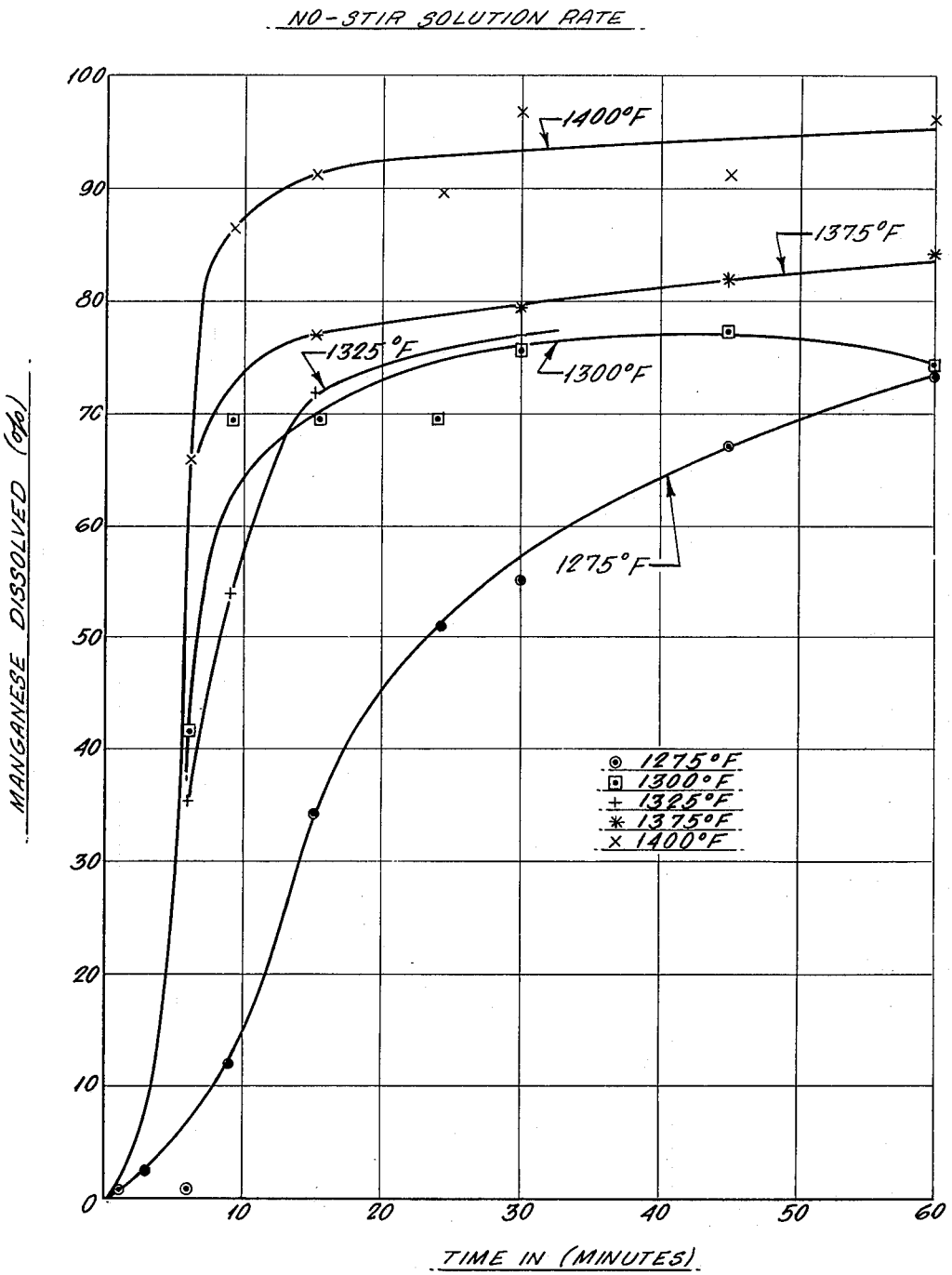

The influence of temperature on the performance of additive (A) of the present invention was also determined by running a series of tests according to Example 1 at melt temperatures of 690°C. (1275°F.); 704°C. (1300°F.); 719°C. (1305°F.); 746°C. (1375°F.); and 760°C. (1400°F); respectively. The percentage of manganese in the melt was plotted against time in FIG. 2, for each of these tests.

EXAMPLES 9 AND 10

Two additional no-stir tests were conducted by the procedure of Example 1, employing a commercial particulate phenolic resin in solid form as opposed to the preferred microballoons.

| | Example 9 | Example 10 |
|---|---|---|
| Test Temperature | 1375°F. | 1300°F. |
| Mn | 2268 | 2268 |
| KCl | 100.8 | 100.8 |
| NaCl | 100.8 | 100.8 |
| Cryolite | 50.4 | 50.4 |
| Phenolic Resin (solid) | 36 | 18 |
| % Mn at 15 minutes | .93 | .89 |
| Final Mn Recovery | 92 | 93 |
| Clinker Weight (grams) | 372 | 0 |

The above data indicates that the solid phenolic resin also gave good results in terms of the rate of solution of the manganese.

EXAMPLES 11 – 16

In order to illustrate the use of the invention in dissolving powdered chromium metal in molten aluminum, the procedure of Example 1 was carried out using two different types of chromium, i.e., (1) aluminothermic chromium powder having a particle size of minus 60 mesh and an analysis of 99.26% Cr, 0.11% Al, 0.31% Fe, 0.12% Si, 0.04% C and 0.01% S; and (2) electrolytic chromium of the same particle size having an analysis of 99.48% Cr, 0.01% Al, 0.45% Fe, 0.007% Si, 0.021% C and 0.026% S. The additives contained 453.6 g. of chromium in an attempt to achieve a level of about 0.25% in the 400 lb. melt of aluminum. Example 11 was run using only the powdered chromium; Example 12 employed an additive of chromium powder and flux; and Example 13 was run with an additive of the present invention containing chromium powder, flux and 7 g. of microballoons, as shown below.

| | Example - (Weights in Grams) 11 | 12 | 13 |
|---|---|---|---|
| Aluminothermic Chromium Powder | 453.6 | 453.6 | 453.6 |
| KCl | | 20.2 | 20.2 |
| NaCl | | 20.2 | 20.2 |
| Cryolite | | 10.1 | 10.1 |
| Phenolic Micro-balloons | | | 7.0 |

| | Example - (Weights in Grams) 14 | 15 | 16 |
|---|---|---|---|
| Electrolytic Chromium Powder | 453.6 | 453.6 | 453.6 |
| KCl | | 20.2 | 20.2 |
| NaCl | | 20.2 | 20.2 |
| Cryolite | | 10.1 | 10.1 |
| Phenolic Micro-balloons | | | 7.0 |

All tests were conducted at 1300°F. In Example 11, a no stir test employing only the aluminothermic chromium powder without flux or microballoons only 0.003% of chromium was found in solution after 15 minutes and final recovery was 64% with no clinker, which indicated a very unsatisfactory solution rate. In Example 12 a no stir test in which the same metal was mixed with flux only, 0.025% of chromium was dissolved in the bath at the end of 15 minutes, final recovery being 81% with no clinker. Therefore, the flux increased the solution rate from 0.003 to 0.025% at 15 minutes. In Example 13, the invention was illustrated by employing both flux and microballoons in a no stir test and a concentration of chromium of 0.07% was achieved at 15 minutes, with a 78% final recovery and no clinker. It is seen, therefore, that the invention provided a 20-fold increase in the level of dissolved chromium over that of Example 11, and a 280% increase over the solution rate with flux alone as in Example 12. In a regular stir test the composition of Example 13 provided a still higher level of chromium (0.159%) in the bath after 15 minutes with a 97% final recovery and no clinker.

Examples 14, 15 and 16 were conducted in the same manner as Examples 11, 12 and 13 above but substituting the electrolytic chromium powder. In Example 14, a no stir test using no flux or microballoons the 15 minute chromium solution level was again only 0.003%, final recovery being 69% with no clinker. In Example 15 using flux only with the powdered chromium, the 15 minute solution level was only 0.015%, even less than Example 12, with a final recovery of 81% and no clinker. Example 16 illustrating the invention, gave a much better 15 minute chromium concentration in the bath of 0.08%, with 84% final recovery and no clinker. From the foregoing it is clear, therefore, that the invention does provide a marked increase in the rate of solution of powdered chromium in molten aluminum.

EXAMPLES 17 AND 18

It has also been found that chromium and manganese may be added to molten aluminum by means of alloys of these metals. Suitable alloys for this purpose are low carbon ferroalloys, i.e., ferroalloys containing up to about 2% carbon. To illustrate this fact, the procedure of Example 1 was followed in Example 17 using a low carbon ferrochromium having the following analysis: Fe 26.55%; Cr 72.95%; C .05%, and Si 0.32%. Similarly, the procedure of Example 1 was repeated in Example 18 using a low carbon ferromanganese having the following analysis: Fe 6.07%; Mn 92.45%; C 0.06%; and Si 0.62%.

In Example 17, sufficient low carbon ferrochromium was used to add 0.25% of chromium to the aluminum melt. When this alloy was added in admixture with the flux of Example 1, after 15 minutes the concentration of chromium dissolved in the bath was 0.013%. The recovery of chromium was 69%, and no clinker was formed. In comparison, when the ferrochromium was admixed with both flux and microballoons as in Example 1, the 15 minute concentration of chromium dissolved in the bath jumped to 0.117%; total recovery of chromium being 91% and no clinker being formed.

In Example 18, sufficient ferromanganese was used to add 1.27% of manganese to the molten aluminum. When the ferromanganese was added alone without flux or microballoons only 0.07% manganese was dissolved after 15 minutes; the recovery being only 35%. A larger clinker weighing 2156 g. also remained. However, when the flux and microballons of Example 1 were admixed with the ferromanganese, a 15 minute dissolved concentration of 0.55% Mn was obtained in the aluminum bath. The final recovery was 77%, with no clinker remaining.

While the invention has been described above in conjunction with certain preferred embodiments thereof, it is to be understood that these embodiments are merely illustrative of others which will now be apparent to those skilled in the art and that the invention is limited only by the prior art and the scope of the appended claims.

What is claimed is:

1. A composition consisting essentially of particulate alloying metal selected from the group consisting of manganese, manganese alloys, chromium, and chromium alloys, substantially all of which is minus 14 mesh, particulate phenolic resin, and a flux which forms a molten phase at the temperature of molten aluminum, the alloying metal constituting about 90 to about 97% and the flux about 3 to about 10% of the total weight of alloying metal and flux, and the ratio of the total volume of the alloying metal and flux to the volume of phenolic resin being in the range from about 2:1 to about 16:1.

2. A composition according to claim 1 wherein the phenolic resin is in the form of microballoons.

3. A composition according to claim 1 wherein the alloying metal is selected from the group consisting of low carbon ferrochromium and low carbon ferromanganese.

4. A composition according to claim 1 wherein the flux consists essentially of non-hygroscopic metal salts.

5. A composition according to claim 4 wherein the non-hygroscopic metal salts are selected from the group consisting of metal chlorides, metal fluorides and mixtures of said chlorides and fluorides.

6. A composition according to claim 5 wherein said metal chlorides are selected from the group consisting of the chlorides of sodium, potassium, aluminum, titanium and zirconium, and said metal fluorides are selected from the group consisting of sodium, potassium, aluminum, titanium, zirconium and manganese.

7. A composition according to claim 6 wherein said flux is a mixture of sodium chloride, potassium chloride and cryolite.

8. A composition according to claim 7 wherein said flux contains about 40% sodium chloride, about 40% potassium chloride and about 20% cryolite, by weight.

* * * * *